US008172723B1

(12) United States Patent
Yanev et al.

(10) Patent No.: US 8,172,723 B1
(45) Date of Patent: May 8, 2012

(54) PERSONAL EXERCISE DEVICE

(75) Inventors: Kostadin Dimitrov Yanev, Alamo, CA (US); Angel Marinov Angelov, Castro Valley, CA (US); Kamen Radev Dobrev, Varna (BG); Asen Angelov Marinov, Castro Valley, CA (US); Paul Gerard Roybal, San Jose, CA (US); Bojidar Kostadinov Vitanov, Sofia (BG)

(73) Assignee: EZ as a Drink Productions, Inc., Venice, CA (US)

( * ) Notice: Subject to any disclaimer, the term of this patent is extended or adjusted under 35 U.S.C. 154(b) by 16 days.

(21) Appl. No.: 12/876,622

(22) Filed: Sep. 7, 2010

Related U.S. Application Data

(60) Provisional application No. 61/284,229, filed on Dec. 15, 2009.

(51) Int. Cl.
*A63B 71/00* (2006.01)

(52) U.S. Cl. ..... 482/8; 482/1; 482/9

(58) Field of Classification Search ..... 482/1–9, 482/900–902; 434/247
See application file for complete search history.

(56) References Cited

U.S. PATENT DOCUMENTS

| | | | | |
|---|---|---|---|---|
| 4,824,103 | A * | 4/1989 | Smidt | 482/9 |
| 5,890,995 | A * | 4/1999 | Bobick et al. | 482/4 |
| 5,904,639 | A | 5/1999 | Smyser et al. | 482/91 |
| 6,013,007 | A | 1/2000 | Root et al. | 482/8 |
| 6,183,425 | B1 | 2/2001 | Whalen et al. | 600/592 |
| 6,227,968 | B1 | 5/2001 | Suzuki et al. | 463/7 |
| 6,360,597 | B1 | 3/2002 | Hubbard, Jr. | 73/172 |
| 6,405,278 | B1 | 6/2002 | Liepe | 711/103 |
| 6,595,901 | B2 | 7/2003 | Reinbold et al. | 482/91 |
| 6,605,038 | B1 * | 8/2003 | Teller et al. | 600/300 |
| 6,616,579 | B1 | 9/2003 | Reinbold et al. | 482/91 |
| 6,675,130 | B2 | 1/2004 | Kanevsky et al. | 702/188 |
| 6,776,345 | B1 | 8/2004 | Liang | 235/486 |
| 6,807,869 | B2 | 10/2004 | Farringdon et al. | 73/862.046 |
| 6,837,827 | B1 | 1/2005 | Lee et al. | 482/8 |
| 6,914,695 | B2 | 7/2005 | Walters et al. | 358/1.15 |
| 6,956,833 | B1 | 10/2005 | Yukie et al. | 370/328 |
| 6,975,644 | B2 | 12/2005 | Tordera et al. | 370/463 |
| 7,292,867 | B2 | 11/2007 | Werner et al. | 455/456.3 |
| 7,398,151 | B1 | 7/2008 | Burrell et al. | 701/200 |

(Continued)

OTHER PUBLICATIONS

"Fitness Made Fun", WiiFit™, Instruction Booklet, copyright 2008 Nintendo, 28 pages.

*Primary Examiner* — Glenn Richman
(74) *Attorney, Agent, or Firm* — Pillsbury Winthrop Shaw Pittman LLP

(57) ABSTRACT

An exercise system may include an exercise device. The exercise device may be configured to facilitate personal exercise and quantification thereof. The exercise device may include a housing body configured to receive compressive force during personal exercise. Personal exercise may include an exercise performed by a user involving one or more body parts of the user such as an arm, hand, leg, foot, torso, neck, and/or other body part. The exercise device may include a force sensor carried by the housing body. The forces sensor may be configured to generate an output signal responsive to compressive force being exerted on the housing body. The exercise device may include one or more processors carried by the housing body. The one or more processors may be configured to execute one or more computer program modules to, among other things determine one or more exercise parameters based on the output signal of the force sensor.

15 Claims, 6 Drawing Sheets

U.S. PATENT DOCUMENTS

| | | | | |
|---|---|---|---|---|
| 7,468,968 | B2 | 12/2008 | Svensson et al. | 370/338 |
| 7,480,512 | B2 | 1/2009 | Graham et al. | 455/456.3 |
| 7,526,314 | B2 | 4/2009 | Kennedy | 455/556.1 |
| 7,526,954 | B2 | 5/2009 | Haselhurst et al. | 73/172 |
| 7,643,895 | B2 | 1/2010 | Gupta et al. | 700/94 |
| 7,699,757 | B2 | 4/2010 | Clem et al. | 482/49 |
| 7,702,821 | B2 | 4/2010 | Feinberg et al. | 710/13 |
| 7,758,469 | B2 | 7/2010 | Dyer et al. | 482/4 |
| 7,789,800 | B1 * | 9/2010 | Watterson et al. | 482/8 |
| 2001/0049470 | A1 | 12/2001 | Mault et al. | 600/300 |
| 2002/0146670 | A1 | 10/2002 | Selles et al. | 434/247 |
| 2007/0219059 | A1 | 9/2007 | Schwartz et al. | 482/8 |
| 2008/0100718 | A1 | 5/2008 | Louks et al. | 348/211.2 |
| 2008/0101272 | A1 | 5/2008 | Hayes et al. | 370/313 |
| 2008/0146336 | A1 | 6/2008 | Feldman et al. | 463/37 |
| 2008/0161051 | A1 | 7/2008 | Schobbert et al. | 455/558 |
| 2008/0262918 | A1 | 10/2008 | Wiener | 705/14 |
| 2009/0144080 | A1 | 6/2009 | Gray et al. | 705/2 |

* cited by examiner

PERSONAL EXERCISE DEVICE

CROSS REFERENCE TO RELATED APPLICATIONS

The present application claims the priority benefit of U.S. provisional patent application Ser. No. 61/284,229 filed Dec. 15, 2009, the disclosure of which is incorporated herein by reference.

FIELD OF THE INVENTION

The invention relates to a device configured to receive compressive force during personal exercise and to analyze the compressive force to determine one or more exercise parameters.

BACKGROUND OF THE INVENTION

Apparatus used during personal exercise are typically considered either stationary or portable. Stationary apparatus may be configured to quantify various aspects of an exercise routine, such as number of repetitions, calories burnt, etc. Portable apparatus generally include much less functionality relative to larger, stationary apparatus.

SUMMARY

One or more aspects of the invention relate to an exercise system configured to facilitate and quantify personal exercise. Some implementations of the exercise system include an exercise device that can be used in various personal exercises. In exemplary implementations, the exercise device may be portable, compact (e.g., handheld), single-body, lightweight, battery powered, and/or sufficiently ruggedized to withstand compressive forces endured during personal exercise. Personal exercise may include static exercises, dynamic exercise, and/or other exercises. As such, personal exercise may include an exercise performed by a user involving at least one body part of the user. The at least one body part may include, for example, arms, hands, legs, feet, torso, neck, and/or other body parts of the user. To illustrate by non-limiting example, the exercise device may be placed between the user's hands such that personal exercise is performed as the user presses on the exercise device from opposite directions, thus exerting a compressive force. Some implementations of the exercise device may measure and/or record compressive force applied thereto as well as duration of personal exercise and/or compressive force, force profile of compressive force, and/or other metrics related to personal exercise. This and/or other information may be used to determine one or more exercise parameters related to personal exercise of the user, as described further below.

In addition to the exercise device, according to some implementations, the exercise system may include one or more of a computing platform, a user accessory, external resources, and/or other components, which may complement and/or include various functionalities attributed herein to the exercise device. Components of the system, such as the exercise device, the computing platform, the user accessory, and/or the external resources, may be operatively linked via one or more electronic communication links. For example, such electronic communication links may be established, at least in part, via a wired or wireless network, which may include the Internet, WiFi, LAN, and/or other networks.

As mentioned above, the exercise device may configured for personal exercise and quantification thereof. The exercise device may include one or more of a housing body, a force sensor, display apparatus, communications apparatus, an actuator, an audio transducer, a user interface, a geo-location sensor, a power supply, electronic storage, one or more processors, and/or other components.

The housing body may be configured to carry one or more other components of the exercise device. These one or more other components may be disposed partially or wholly within the housing body, or be affixed to an external surface of the housing body. In some implementations, the housing body includes a flexible, yet resilient, material such as, for example, flexible, hard rubber. The housing body may include a hinge or joint that permits two or more component portions to pivot relative to each other. The housing body may be formed from two or more component portions configured to move relative to each other in a sliding manner. For example, the two or more component portions may include a first portion and a second portion configured to sit on the outside of part of the first portion, and to slide back and forth thereon. The housing body may be configured to receive compressive force during personal exercise. As such, some implementations of the housing body may include a portable, hand-held form factor.

In some implementations, the housing body may be configured to be coupled to a strap or other apparatus configured for similar functionality attributed herein to the strap. Such a strap may be configured to facilitate exertion of compressive force on the housing body responsive to a tensive force exerted on the strap. The strap may be removably coupled to the housing body by hooks, snaps, hook and loop fasteners, and/or other means for removable coupling.

The force sensor may be carried by the housing body. The force sensor may be configured to generate an output signal responsive to compressive force being exerted on the housing body. The output signal may include information related to compressive force exerted on the housing body. Such information may include or be used to determine magnitude of force, duration of force, a force magnitude profile as a function of time, a quantity of compressive forces, and/or other information related to compressive force exerted on the housing body. The output signal generated by the force sensor may be received and/or utilized by one or more modules of the processor, as described further herein.

The display apparatus may be carried by the housing body. The display apparatus may be configured to display, for presentation to a user of the exercise device, information related to compressive force exerted on the housing body, personal exercise, and/or other information. Such information may be conveyed by images, icons, video, text, illumination of a light or LED, and/or other visual indicators. The display apparatus may include one or more of a screen, an LED, and/or other apparatus configured to provide visual feedback to a user of the exercise device. According to some implementations, the display apparatus may include a touch screen configured to receive information from the user.

The communications apparatus may be carried by the housing body. The communications apparatus may be configured to transmit and/or receive information related to one or more of personal exercise, compressive force exerted on the housing body, and/or other information. Such information may be transmitted to and/or received from other components of the exercise system such as the computing platform, the user accessory, the external resources, and/or other components. As such, the communications apparatus may include a wired or wireless transmitter, a wired or wireless receiver, and/or a combined wired or wireless transmitter and receiver. In some implementations, the communications apparatus may be configured to receive one or more of software updates, firmware updates, and/or other updates.

The actuator may be carried by the housing body. The actuator may be configured to provide tactile feedback to a user of the exercise device. Tactile feedback may be preferable in some use scenarios, for example, where other feedback mechanisms such as audio or visual may be undesired. Tactile feedback may include forces, vibrations, motions, and/or other tactile feedback provided to the user. The actuator may include a mechanical device configured to cause one or more motions of the exercise device. In some implementations, the actuator may include an electric motor with an unbalanced mass on its driveshaft such that rotation of the driveshaft generates vibrations. One or more parameters of the tactile feedback may be varied to convey different information to a user. The parameters may include one or more of direction, source location, frequency, amplitude, and/or other parameters.

The audio transducer may be carried by the housing body. The audio transducer may be configured to provide audio feedback to a user of the exercise device. The audio transducer may include a speaker and/or other audio output device. In some implementations, the audio transducer may be separate from the housing body and communicatively coupled to the exercise device via the communications apparatus. The audio transducer in such implementations may be carried by wired or wireless headphones, and/or other listening apparatus.

The user interface may be carried by the housing body. The user interface may be configured to receive information from the user and/or provide information to the user. As such, the user interface may include hardware and/or software to facilitate receiving information from the user and/or providing information to the user. Exemplary hardware may include one or more of buttons, dials, touch pads, switches, analog sticks, a keypad, and/or other hardware. In accordance with some implementations, some or all of the user interface may be presented to the user via the display apparatus. In implementations where the display apparatus includes a touch screen, the user may provide information to the user interface by manipulating the touch screen.

In some implementations, the user interface may be configured to present user configurable settings to the user. The user interface may be configured to receive selections from the user of values for the user configurable settings. One or more user configurable settings may impact the current activity of one or more components of the exercise device. By way of non-limiting example, the user configurable settings may active and/or deactivate one or more components of the exercise device, and/or may configure one or more aspects of operation of the exercise device. The user configurable settings may be related to personal exercise of a user of the exercise device. The user configurable settings may be provided to the processor of the exercise device. The user configurable settings may be provided to one or more processors of the computing platform and/or the user accessory.

The geo-location sensor may be carried by the housing body. The geo-location sensor may be configured to generate a second output signal related to a geo-location of the exercise device. The second output signal may be used to quantify one or more parameters of personal exercise. Such parameters may include speed, distance traveled, course of travel, and/or other parameters related to a geo-location of the exercise device.

The power supply may be carried by the housing body. The power supply may be configured to supply electrical power to one or more components of the exercise device. In some implementations, the power supply may be rechargeable. In one implementation, where the communications apparatus includes a USB port or other wired communications port, the communications apparatus may received electrical power from a component of the exercise system and/or another source to recharge the power supply.

The electronic storage may be carried by the housing body. The electronic storage may be configured to store information related to compressive force exerted on the housing body, personal exercise, and/or other information. The electronic storage may comprise electronic storage media that electronically stores information. The electronic storage may store software algorithms, information determined by processor, information received from computing platform, information received from the user accessory, information received from the external resources, and/or other information that enables the exercise device to function as described herein.

The processor(s) may be configured to provide information processing capabilities in the exercise device. The processor may be configured to execute one or more computer program modules. The one or more computer program modules may include one or more of a sensor module, an exercise analysis module, a display module, a communications module, a tactile feedback module, an audio module, a power management module, a coaching module, and/or other modules.

The sensor module may be configured to receive an output signal from the force sensor. The sensor module may be configured to receive a second output signal from the geo-location sensor. Signals received by the sensor module may be provided to one or more of modules of the processor. In some implementations, the sensor module may be configured to timestamp received signals or information included in received signals.

The exercise analysis module may be configured determine one or more exercise parameters. The exercise parameters may be related to personal exercise of a user of the exercise device. The one or more exercise parameters may be based on the output signal of the force sensor received by the sensor module and/or the second output signal of the geo-location sensor received by the sensor module. The one or more exercise parameters may include, for example, magnitude of compressive force exerted on the housing body, duration of compressive force exerted on the housing body, a force magnitude profile as a function of time, a quantity of compressive forces exerted on the housing body, completion level of a prescribed exercise routine, speed, acceleration, distance traveled, course of travel, and/or other information related to personal exercise.

The display module may be configured to control the display apparatus. Control of the display apparatus may include directing the display apparatus to present information related to compressive force exerted on the housing body, personal exercise, and/or other information. Such information may be conveyed by images, icons, video, text, and/or other visual indicators. Information related to compressive force exerted on the housing body may include magnitude of compressive force exerted on the housing body, duration of compressive force exerted on the housing body, a force magnitude profile as a function of time, a quantity of compressive forces exerted on the housing body, and/or other information related to compressive force exerted on the housing body. Information related to personal exercise may include information related to a prescribed exercise routine, a previously completed exercise routine, an exercise routing of an individual besides the user of the exercise device, speed, distance traveled, course of travel, and/or other information related to personal exercise. In some implementations, the display module may control the display apparatus to indicate an operational state of the exercise device. Operational states may include "on", "off", "stand-by", and/or other operational states.

The communications module may be configured to the communications apparatus to transmit and/or receive information. In some implementations, the communications apparatus may be controlled to transmit and/or receive information related to one or more of personal exercise, compressive force exerted on the housing body, and/or other information. Such information may be transmitted to and/or received from other components of the exercise system such as the computing platform, the user accessory, the external resources, and/or other components.

The tactile feedback module may be configured to control the actuator to provide tactile feedback for a user of the exercise device. Tactile feedback may include forces, vibrations, motions, and/or other tactile feedback provided to the user. The tactile feedback module may direct the actuator to provide tactile feedback responsive to compressive force being exerted on the housing body, a threshold magnitude of compressive force exerted on the housing body, a threshold quantity of compressive forces exerted on the housing body, divergence from a prescribed compressive force profile, an action performed by a user of the exercise device, an operational state of the exercise device, and/or other events associated with or states of the exercise device.

The audio module may be configured to control the audio transducer to provide the audio feedback. Audio feedback may include tones, beeps, sounds, verbal messages (e.g., prerecorded spoken language and/or artificial voice), and/or other audio signals. The audio module may direct the audio transducer to provide audio feedback responsive to compressive force being exerted on the housing body, a threshold magnitude of compressive force exerted on the housing body, a thresholds quantity of compressive forces exerted on the housing body, divergence from a prescribed compressive force profile, an action performed by a user of the exercise device, an operational state of the exercise device, and/or other events or states of the exercise device.

The power management module may be configured to manage power delivered by the power supply to one or more components of the exercise device. In some implementations, the power management module may temporarily discontinue or reduce power being supplied to one or more components of the exercise device when those component(s) are not currently in use by a user, such as the display apparatus and/or other components. As such, the power management module may extend the lifetime of the power supply or an individual charge thereof.

The coaching module may be configured to provide verbal and/or textual conveyance of information related to personal exercise. Such information may include one or more of exercise parameters determined by the exercise analysis module, coaching tips related to personal exercise, encouraging statements, guidance related to personal exercise, comparative information of current personal exercise or prior personal exercise, and/or other information related to personal exercise. Conveyance of this information may be performed in conjunction with one or more of the display apparatus, the communications apparatus, actuator, the audio transducer, the user interface, and/or other components of the exercise system. In implementations where the communications apparatus take part in conveyance of information associated with the coaching module, the conveyance may be via the computing platform, the user accessory, and/or other component of the exercise system.

The computing platform may be configured to communicatively couple to the exercise device and/or other components of the exercise system. The computing platform may be configured to receive, transmit, process, and/or store information related to one or both of personal exercise or compressive force exerted on the housing body. Processing of such information may include analysis, historical tracking, sharing with one or more individuals other than a user of the exercise device, and/or other processing. The computing platform may be physically separate and distinct from the exercise device. The computing platform may include one or more processors configured to execute computer program modules that provide the functionalities attributed herein to the computing platform. According to some implementations, the computing platform may include one or more of a personal computer, a laptop computer, a tablet computer, a Smart phone, a personal digital assistant (PDA), and/or other computing platforms.

The user accessory may be configured to communicatively couple to the exercise device and/or other components of the exercise system. The user accessory may be configured to convey information related to one or more of personal exercise, compressive force exerted on the housing body, information associated with the coaching module, and/or other information. Such information may be conveyed visually and/or audibly. The user accessory may be physically separate and distinct from the exercise device. In some implementations, the user accessory may include one or more of a wired headset, a wireless headset, wired headphones, wireless headphones, a device that includes a display, and/or other accessories.

The external resources may include sources of information, hosts and/or providers of interactive content outside of the exercise system, external entities participating with the exercise system, and/or other resources. In some implementations, some or all of the functionality attributed herein to the external resources may be provided by resources included in the exercise system.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
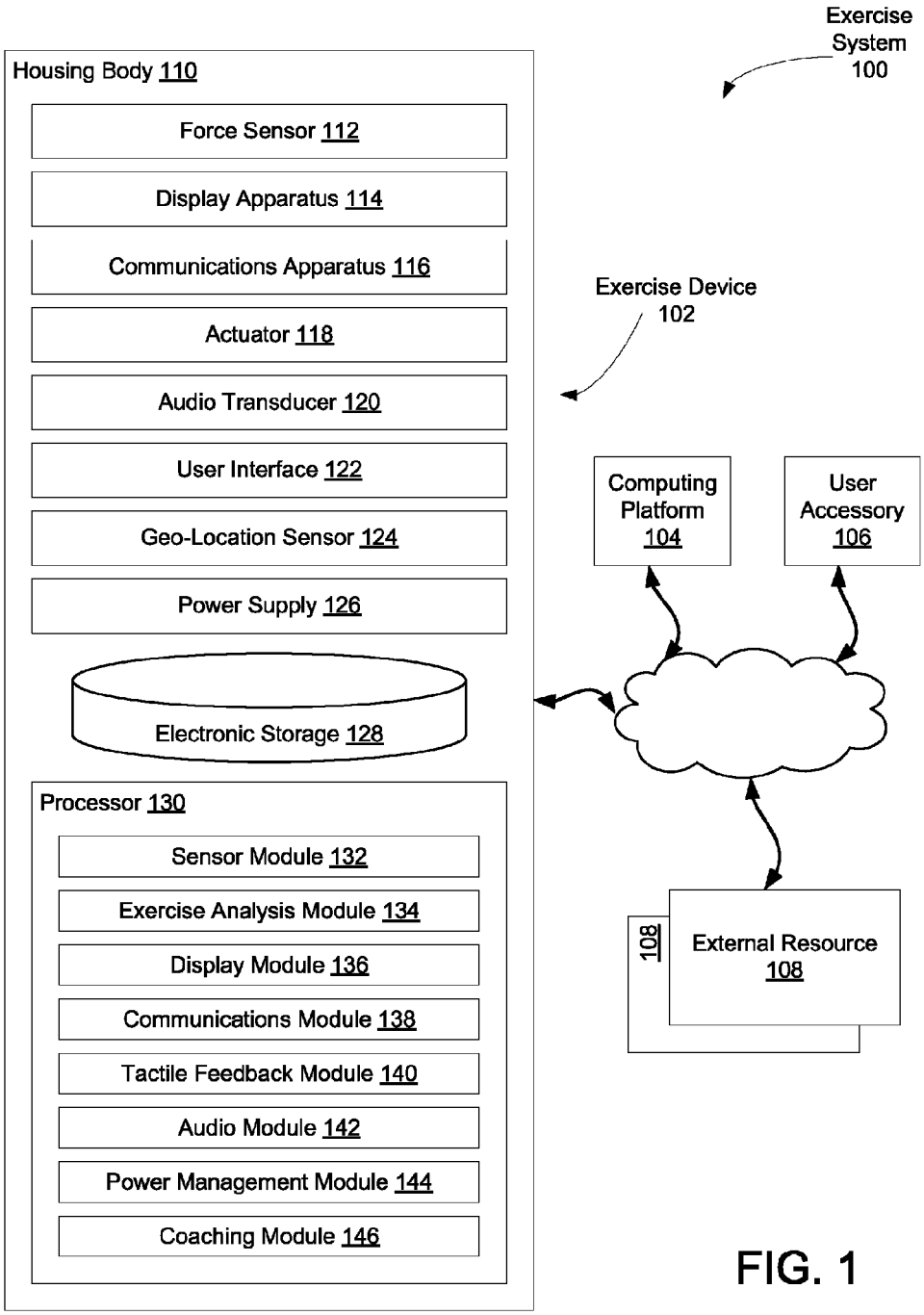
FIG. 1 illustrates an exercise system configured to facilitate and quantify personal exercise, according to one or more implementations of the invention.

FIG. 1 illustrates an exercise system 100 configured to facilitate and quantify personal exercise, according to one or more implementations of the invention. Some implementations of the exercise system 100 include an exercise device 102 that can be used in various personal exercises. In exemplary implementations, the exercise device 102 may be portable, compact (e.g., handheld), single-body, lightweight, battery powered, and/or sufficiently ruggedized to withstand compressive forces endured during personal exercise. Personal exercise may include static exercises, dynamic exercise, and/or other exercises. As such, personal exercise may include an exercise performed by a user involving at least one body part of the user. The at least one body part may include, for example, arms, hands, legs, feet, torso, neck, and/or other body parts of the user. To illustrate by non-limiting example, the exercise device 102 may be placed between the user's hands such that personal exercise is performed as the user presses on the exercise device 102 from opposite directions, thus exerting a compressive force. Some implementations of the exercise device 102 may measure and/or record compressive force applied thereto as well as duration of personal exercise and/or compressive force, force profile of compressive force, and/or other metrics related to personal exercise. This and/or other information may be used to determine one or more exercise parameters related to personal exercise of the user, as described further below.

In addition to the exercise device 102, according to some implementations, the exercise system 100 may include one or more of a computing platform 104, a user accessory 106, external resources 108, and/or other components, which may complement and/or include various functionalities attributed herein to the exercise device 102. Components of the system 100, such as the exercise device 102, the computing platform 104, the user accessory 106, and/or the external resources 108, may be operatively linked via one or more electronic communication links. For example, such electronic communication links may be established, at least in part, via a wired or wireless network, which may include the Internet, WiFi, LAN, and/or other networks. It will be appreciated that this is not intended to be limiting, and that the scope of this disclosure includes implementations in which the exercise device 102, the computing platform 104, the user accessory 106, and/or the external resources 108 are operatively linked via some, other communication media.

As mentioned above, the exercise device 102 may configured for personal exercise and quantification thereof. As depicted in FIG. 1, the exercise device 102 may include one or more of a housing body 110, a force sensor 112, display apparatus 114, communications apparatus 116, an actuator 118, an audio transducer 120, a user interface 122, a geolocation sensor 124, a power supply 126, electronic storage 128, one or more processors 130, and/or other components.

The housing body 110 may be configured to carry one or more other components of the exercise device 102. These one or more other components may be disposed partially or wholly within the housing body 110, or be affixed to an external surface of the housing body 110. In some implementations, the housing body 110 includes a flexible, yet resilient, material such as, for example, flexible, hard rubber. The housing body 110 may include a hinge or joint that permits two or more component portions to pivot relative to each other. The housing body 110 may be formed from two or more component portions configured to move relative to each other in a sliding manner. For example, the two or more component portions may include a first portion and a second portion configured to sit on the outside of part of the first portion, and to slide back and forth thereon. The housing body 110 may be configured to receive compressive force during personal exercise. As such, some implementations of the housing body 110 may include a portable, hand-held form factor.

In some implementations, the housing body 110 may be configured to be coupled to a strap (not depicted in FIG. 1) or other apparatus configured for similar functionality attributed herein to the strap. Such a strap may be configured to facilitate exertion of compressive force on the housing body responsive to a tensive force exerted on the strap. The strap may be removably coupled to the housing body 110 by hooks, snaps, hook and loop fasteners, and/or other means for removable coupling.

The force sensor 112 may be carried by the housing body 110. The force sensor 112 may be configured to generate an output signal responsive to compressive force being exerted on the housing body 110. The output signal may include information related to compressive force exerted on the housing body 110. Such information may include or be used to determine magnitude of force, duration of force, a force magnitude profile as a function of time, a quantity of compressive forces, and/or other information related to compressive force exerted on the housing body 110. The output signal generated by the force sensor 112 may be received and/or utilized by one or more modules of the processor 130, as described further herein. By way of non-limiting example, the force sensor 112 may include a FlexiForce A201 force sensor from Tekscan. However, other apparatus configured for force sensing are contemplated and within the scope of the invention.

The display apparatus 114 may be carried by the housing body 110. The display apparatus 114 may be configured to display, for presentation to a user of the exercise device 102, information related to compressive force exerted on the housing body 110, personal exercise, and/or other information. Such information may be conveyed by images, icons, video, text, illumination of a light or LED, and/or other visual indicators. In some implementations, the display apparatus 114 may be separate from the exercise device 102 and communicatively coupled with the exercise device 102. The display apparatus 114 may include one or more of a screen, an LED, and/or other apparatus configured to provide visual feedback to a user of the exercise device 102. According to some implementations, the display apparatus 114 may include a touch screen configured to receive information from the user.

The communications apparatus 116 may be carried by the housing body 110. The communications apparatus 116 may be configured to transmit and/or receive information related to one or more of personal exercise, compressive force exerted on the housing body 110, and/or other information. Such information may be transmitted to and/or received from other components of the exercise system 100 such as the computing platform 104, the user accessory 106, the external resources 108, and/or other components. As such, the communications apparatus 116 may include a wired or wireless transmitter, a wired or wireless receiver, and/or a combined wired or wireless transmitter and receiver. In some implementations, the communications apparatus 116 may be configured to receive one or more of software updates, firmware updates, and/or other updates.

The actuator 118 may be carried by the housing body 110. The actuator 118 may be configured to provide tactile feedback to a user of the exercise device 102. Tactile feedback may be preferable in some use scenarios, for example, where other feedback mechanisms such as audio or visual may be undesired. Tactile feedback may include forces, vibrations, motions, and/or other tactile feedback provided to the user. The actuator 118 may include a mechanical device configured to cause one or more motions of the exercise device 102. In some implementations, the actuator 118 may include an electric motor with an unbalanced mass on its driveshaft such that rotation of the driveshaft generates vibrations. One or more parameters of the tactile feedback may be varied to convey different information to a user. The parameters may include one or more of direction, source location, frequency, amplitude, and/or other parameters.

The audio transducer 120 may be carried by the housing body 110. The audio transducer 120 may be configured to provide audio feedback to a user of the exercise device 102. The audio transducer 120 may include a speaker and/or other audio output device. In some implementations, the audio transducer 120 may be separate from the housing body 110 and communicatively coupled to the exercise device 102 via the communications apparatus 116. The audio transducer 120 in such implementations may be carried by wired or wireless headphones, and/or other listening apparatus.

The user interface 122 may be carried by the housing body 110. The user interface 122 may be configured to receive information from the user and/or provide information to the user. As such, the user interface 122 may include hardware and/or software to facilitate receiving information from the user and/or providing information to the user. Exemplary hardware may include one or more of buttons, dials, touch pads, switches, analog sticks, a keypad, and/or other hardware. In accordance with some implementations, some or all of the user interface 122 may be presented to the user via the display apparatus 114. In implementations where the display apparatus 114 includes a touch screen, the user may provide information to the user interface 122 by manipulating the touch screen.

In some implementations, the user interface 122 may be configured to present user configurable settings to the user. The user interface 122 may be configured to receive selections from the user of values for the user configurable settings. One or more user configurable settings may impact the current activity of one or more components of the exercise device 102. By way of non-limiting example, the user configurable settings may active and/or deactivate one or more components of the exercise device 102, and/or may configure one or more aspects of operation of the exercise device 102. The user configurable settings may be related to personal exercise of a user of the exercise device 102. The user configurable settings may be provided to the processor 130 of the exercise device 102. The user configurable settings may be provided to one or more processors of the computing platform 104 and/or the user accessory 106.

The geo-location sensor 124 may be carried by the housing body 110. The geo-location sensor 124 may be configured to generate a second output signal related to a geo-location of the exercise device 102. The second output signal may be used to quantify one or more parameters of personal exercise. Such parameters may include speed, distance traveled, course of travel, and/or other parameters related to a geo-location of the exercise device 102. By way of non-limiting example, the geo-location sensor 124 may include a GPS device and/or other device configured to generate signals related to geo-location.

The power supply 126 may be carried by the housing body 110. The power supply 126 may be configured to supply electrical power to one or more components of the exercise device 102. By way of non-limiting example, the power supply 126 may include a battery, a capacitor, apparatus for receiving electrical power from an external source (e.g., a wall socket), and/or other power supplies. In some implementations, the power supply 126 may be rechargeable. In one implementation, where the communications apparatus 116 includes a USB port or other wired communications port, the communications apparatus 116 may received electrical power from a component of the exercise system 100 and/or another source to recharge the power supply 126.

The electronic storage 128 may be carried by the housing body 110. The electronic storage 128 may be configured to store information related to compressive force exerted on the housing body 110, personal exercise, and/or other information. The electronic storage 128 may comprise electronic storage media that electronically stores information. The electronic storage media of the electronic storage 128 may include one or both of system storage that is provided integrally (i.e., substantially non-removable) with the exercise device 102 and/or removable storage that is removably connectable to the exercise device 102 via, for example, a port (e.g., a USB port, a firewire port, etc.) or a drive (e.g., a disk drive, etc.). The electronic storage 128 may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. The electronic storage 128 may store software algorithms, information determined by processor 130, information received from computing platform 104, information received from the user accessory 106, information received from the external resources 108, and/or other information that enables the exercise device 102 to function as described herein.

The processor(s) 130 may be configured to provide information processing capabilities in the exercise device 102. As such, the processor 130 may include one or more of a digital processor, an analog processor, a digital circuit designed to process information, an analog circuit designed to process information, a state machine, and/or other mechanisms for electronically processing information. Although the processor 130 is shown in FIG. 1 as a single entity, this is for illustrative purposes only. In some implementations, the processor 130 may include a plurality of processing units. These processing units may be physically located within the same device, or the processor 130 may represent processing functionality of a plurality of devices operating in coordination.

As is shown in FIG. 1, the processor 130 may be configured to execute one or more computer program modules. The one or more computer program modules may include one or more of a sensor module 132, an exercise analysis module 134, a display module 136, a communications module 138, a tactile feedback module 140, an audio module 142, a power management module 144, a coaching module 146, and/or other modules. The processor 130 may be configured to execute modules 132, 134, 136, 138, 140, 142, 144, and/or 146 by software; hardware; firmware; some combination of software, hardware, and/or firmware; and/or other mechanisms for configuring processing capabilities on the processor 130.

It should be appreciated that although modules 132, 134, 136, 138, 140, 142, 144, and 146 are illustrated in FIG. 1 as being co-located within a single processing unit, in implementations in which the processor 130 includes multiple processing units, one or more of modules 132, 134, 136, 138, 140, 142, 144, and/or 146 may be located remotely from the other modules. The description of the functionality provided by the different modules 132, 134, 136, 138, 140, 142, 144, and/or 146 described below is for illustrative purposes, and is not intended to be limiting, as any of modules 132, 134, 136, 138, 140, 142, 144, and/or 146 may provide more or less functionality than is described. For example, one or more of modules 132, 134, 136, 138, 140, 142, 144, and/or 146 may be eliminated, and some or all of its functionality may be provided by other ones of modules 132, 134, 136, 138, 140, 142, 144, and/or 146. As another example, the processor 130 may be configured to execute one or more additional modules that may perform some or all of the functionality attributed below to one of modules 132, 134, 136, 138, 140, 142, 144, and/or 146.

The sensor module 132 may be configured to receive an output signal from the force sensor 112. The sensor module 132 may be configured to receive a second output signal from the geo-location sensor 124. Signals received by the sensor module 132 may be provided to one or more of modules 134, 136, 138, 140, 142, 144, and/or 146. In some implementations, the sensor module 132 may be configured to timestamp received signals or information included in received signals.

The exercise analysis module 134 may be configured determine one or more exercise parameters. The exercise parameters may be related to personal exercise of a user of the exercise device 102. The one or more exercise parameters may be based on the output signal of the force sensor 112 received by the sensor module 132 and/or the second output signal of the geo-location sensor 124 received by the sensor module 132. The one or more exercise parameters may include, for example, magnitude of compressive force exerted on the housing body 110, duration of compressive force exerted on the housing body 110, a force magnitude profile as a function of time, a quantity of compressive forces exerted on the housing body 110, completion level of a prescribed exercise routine, speed, acceleration, distance traveled, course of travel, and/or other information related to personal exercise.

The display module 136 may be configured to control the display apparatus 114. Control of the display apparatus 114 may include directing the display apparatus 114 to present information related to compressive force exerted on the housing body 110, personal exercise, and/or other information. Such information may be conveyed by images, icons, video, text, and/or other visual indicators. Information related to compressive force exerted on the housing body 110 may include magnitude of compressive force exerted on the housing body 110, duration of compressive force exerted on the housing body 110, a force magnitude profile as a function of time, a quantity of compressive forces exerted on the housing body 110, and/or other information related to compressive force exerted on the housing body 110. Information related to personal exercise may include information related to a prescribed exercise routine, a previously completed exercise routine, an exercise routing of an individual besides the user of the exercise device 102, speed, distance traveled, course of travel, and/or other information related to personal exercise. In some implementations, the display module 136 may control the display apparatus 114 to indicate an operational state of the exercise device 102. Operational states may include "on", "off", "stand-by", and/or other operational states.

The communications module 138 may be configured to the communications apparatus 116 to transmit and/or receive information. In some implementations, the communications apparatus 116 may be controlled to transmit and/or receive information related to one or more of personal exercise, compressive force exerted on the housing body 110, and/or other information. Such information may be transmitted to and/or received from other components of the exercise system 100 such as the computing platform 104, the user accessory 106, the external resources 108, and/or other components.

The tactile feedback module 140 may be configured to control the actuator 118 to provide tactile feedback for a user of the exercise device 102. Tactile feedback may include forces, vibrations, motions, and/or other tactile feedback provided to the user. The tactile feedback module 140 may direct the actuator 118 to provide tactile feedback responsive to compressive force being exerted on the housing body 110, a threshold magnitude of compressive force exerted on the housing body 110, a threshold quantity of compressive forces exerted on the housing body 110, divergence from a prescribed compressive force profile, an action performed by a user of the exercise device 102, an operational state of the exercise device 102, and/or other events associated with or states of the exercise device 102.

The audio module 142 may be configured to control the audio transducer 120 to provide the audio feedback. Audio feedback may include tones, beeps, sounds, verbal messages (e.g., prerecorded spoken language and/or artificial voice), and/or other audio signals. The audio module 142 may direct the audio transducer 120 to provide audio feedback responsive to compressive force being exerted on the housing body 110, a threshold magnitude of compressive force exerted on the housing body 110, a thresholds quantity of compressive forces exerted on the housing body 110, divergence from a prescribed compressive force profile, an action performed by a user of the exercise device 102, an operational state of the exercise device 102, and/or other events or states of the exercise device 102.

The power management module 144 may be configured to manage power delivered by the power supply 126 to one or more components of the exercise device 102. In some implementations, the power management module 144 may temporarily discontinue or reduce power being supplied to one or more components of the exercise device 102 when those component(s) are not currently in use by a user, such as the display apparatus 114 and/or other components. As such, the power management module 144 may extend the lifetime of the power supply 126 or an individual charge thereof.

The coaching module 146 may be configured to provide verbal and/or textual conveyance of information related to personal exercise. Such information may include one or more of exercise parameters determined by the exercise analysis module 134, coaching tips related to personal exercise, encouraging statements, guidance related to personal exercise, comparative information of current personal exercise or prior personal exercise, and/or other information related to personal exercise. Conveyance of this information may be performed in conjunction with one or more of the display apparatus 114, the communications apparatus 116, actuator 118, the audio transducer 120, the user interface 122, and/or other components of the exercise system 100. In implementations where the communications apparatus 116 take part in conveyance of information associated with the coaching module 146, the conveyance may be via the computing platform 104, the user accessory 106, and/or other component of the exercise system 100.

The computing platform 104 may be configured to communicatively couple to the exercise device 102 and/or other components of the exercise system 100. The computing platform 104 may be configured to receive, transmit, process, and/or store information related to one or both of personal exercise or compressive force exerted on the housing body 110. Processing of such information may include analysis, historical tracking, sharing with one or more individuals other than a user of the exercise device 102, and/or other processing. The computing platform 104 may be physically separate and distinct from the exercise device. The computing platform 104 may include one or more processors configured to execute computer program modules that provide the functionalities attributed herein to the computing platform 104. According to some implementations, the computing platform 104 may include one or more of a personal computer, a laptop computer, a tablet computer, a Smart phone, a personal digital assistant (PDA), and/or other computing platforms.

The user accessory 106 may be configured to communicatively couple to the exercise device 102 and/or other components of the exercise system 100. The user accessory 106 may be configured to convey information related to one or more of personal exercise, compressive force exerted on the housing body 100, information associated with the coaching module 146, and/or other information. Such information may be conveyed visually and/or audibly. The user accessory 106 may be physically separate and distinct from the exercise device. In some implementations, the user accessory 106 may include one or more of a wired headset, a wireless headset, wired headphones, wireless headphones, a device that includes a display, and/or other accessories.

The external resources 108 may include sources of information, hosts and/or providers of interactive content outside of the exercise system 100, external entities participating with the exercise system 100, and/or other resources. In some implementations, some or all of the functionality attributed herein to the external resources 108 may be provided by resources included in the exercise system 100.

Figure 2:
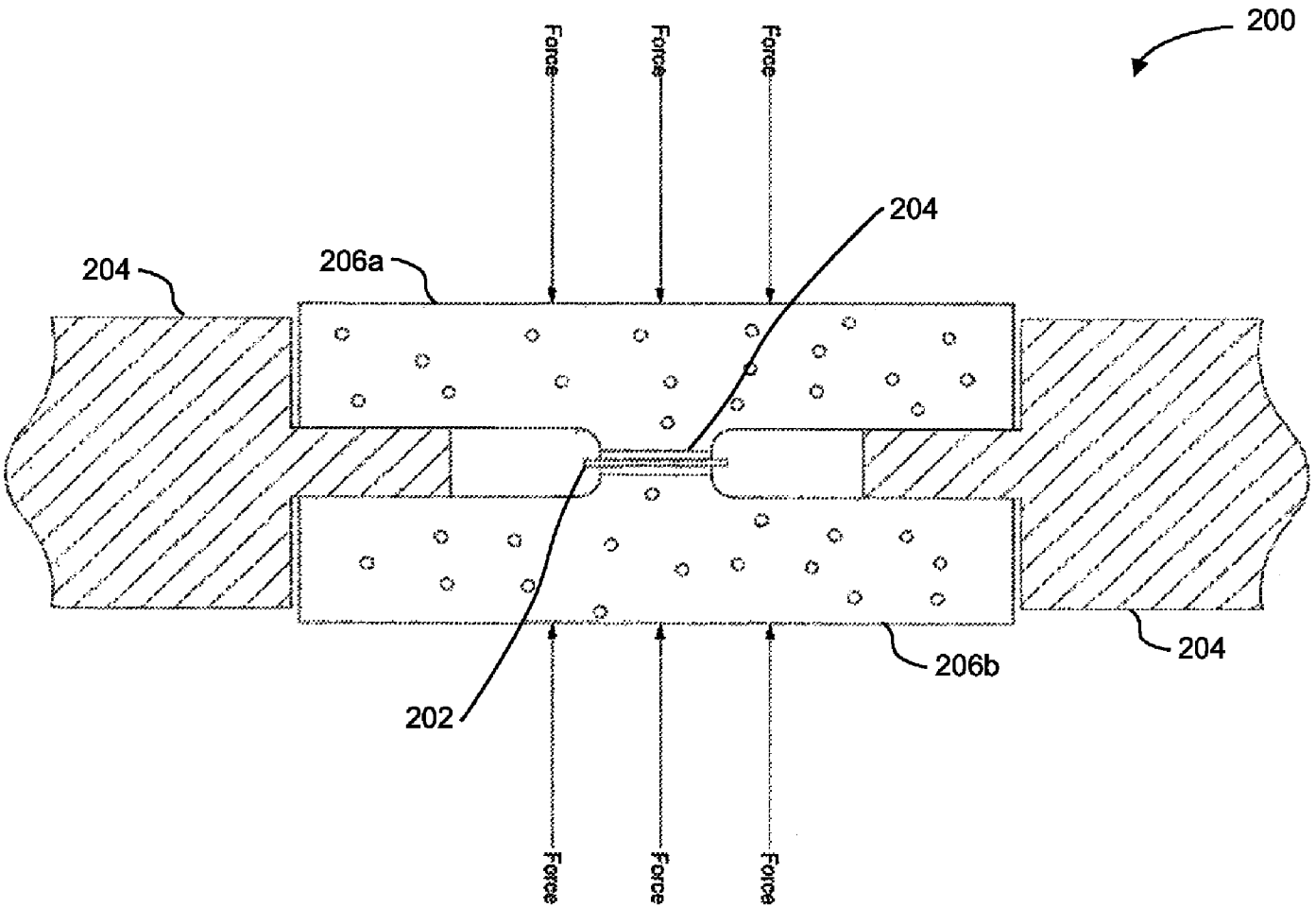
FIG. 2 illustrates a cross-sectional view of a configuration of a force sensor in relation to a housing body of an exercise device, according to one or more implementations of the invention.

FIG. 2 illustrates a cross-sectional view of a configuration 200 of a force sensor 202 in relation to a housing body 204 of an exercise device (e.g., the exercise device 102), according to one or more implementations of the invention. As shown in FIG. 2, the housing body 204 may include flexible components 206*a* and 206*b*. The flexible components 206*a* and 206*b* may be formed of rubber, flexible plastic, and/or other flexible material. The flexible components 206*a* and 206*b* may be disposed on opposite sides of the housing body 204. The flexible components 206*a* and 206*b* may be configured to support the force sensor 202. In the configuration 200, rigid plates 208 may be disposed between the force sensor 202 and the flexible components 206*a* and 206*b*. Compressive forces may be applied in opposite directions to the flexible components 206*a* and 206*b*, which convey the force to the force sensor 202. Such compressive forces may be exerted during personal exercise.

Figure 3:
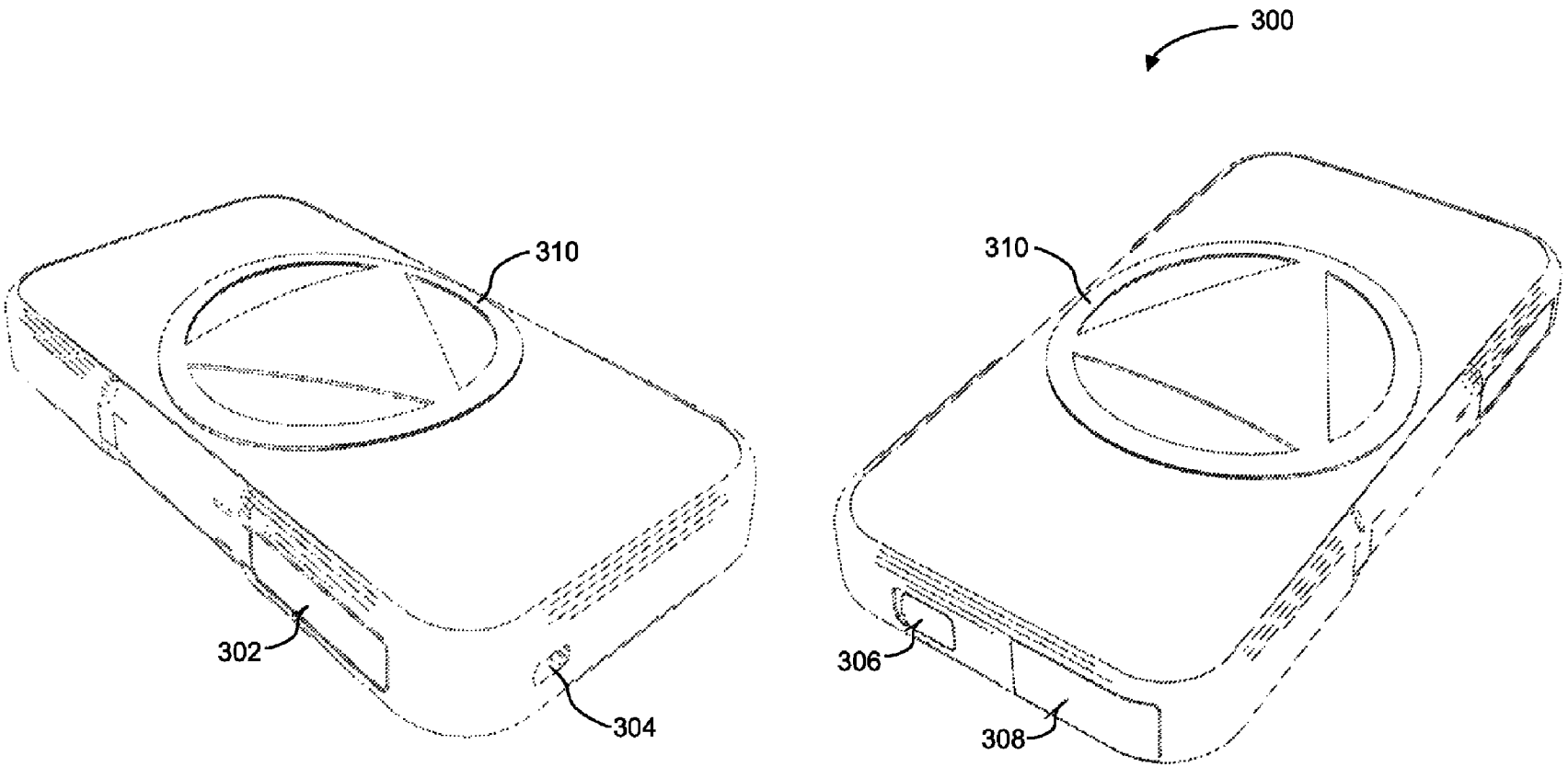
FIG. 3 illustrates perspective views of an exercise device, according to one or more implementations of the invention.

FIG. 3 illustrates perspective views of an exercise device 300, according to one or more implementations of the invention. The exercise device 300 may include one or more characteristics and/or functionalities that are similar to that described in connection with the exercise device 102. As shown in FIG. 3, the exercise device 300 may include one or more of a display apparatus opening 302, an audio transducer opening 304, a communications apparatus opening 306, a power supply lid 308, a flexible component 310, and/or other components. A display apparatus (e.g., the display apparatus 114) may be seen and/or manipulated by a user through the display apparatus opening 302. At least a portion of an audio transducer (e.g., the audio transducer 120) may be exposed through the audio transducer opening 304. A component of a communications apparatus (e.g., the communications apparatus 116) may be accessed via the communications apparatus opening 306. The power supply lid 308 may provide access to a power supply (e.g., power supply 126), such as for replacing, recharging, and/or other maintenance. In some implementations, compressive force may be exerted on the flexible component 310.

Figure 4:
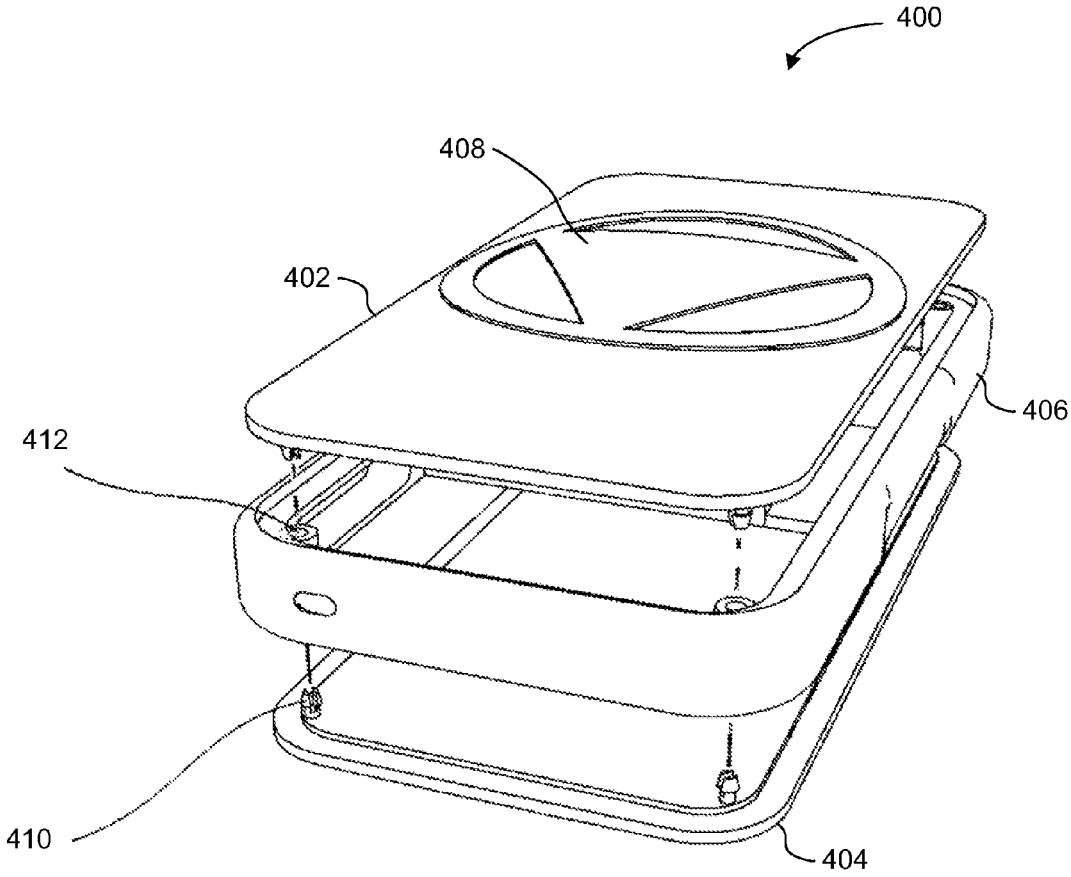
FIG. 4 illustrates an exploded perspective view of a housing body of an exercise device, according to one or more implementations of the invention.

FIG. 4 illustrates an exploded perspective view of a housing body 400 of an exercise device (e.g., the exercise device 102), according to one or more implementations of the invention. As shown FIG. 4, the housing body 400 may include a top cover 402, a bottom cover 404, a frame 406, and/or other components. The top cover 402 may include a flexible component 408 and the bottom cover 404 may include a second flexible component (not depicted in FIG. 4). The top cover 402 and the bottom cover 404 may include clips 410. The frame 406 may include clip openings 412 that are configured to receive the clips 410. The top cover 402 and the bottom cover 404 may be removably or permanently coupled to the frame 406 when the clips 410 are inserted into the clip openings 412.

Figure 5:
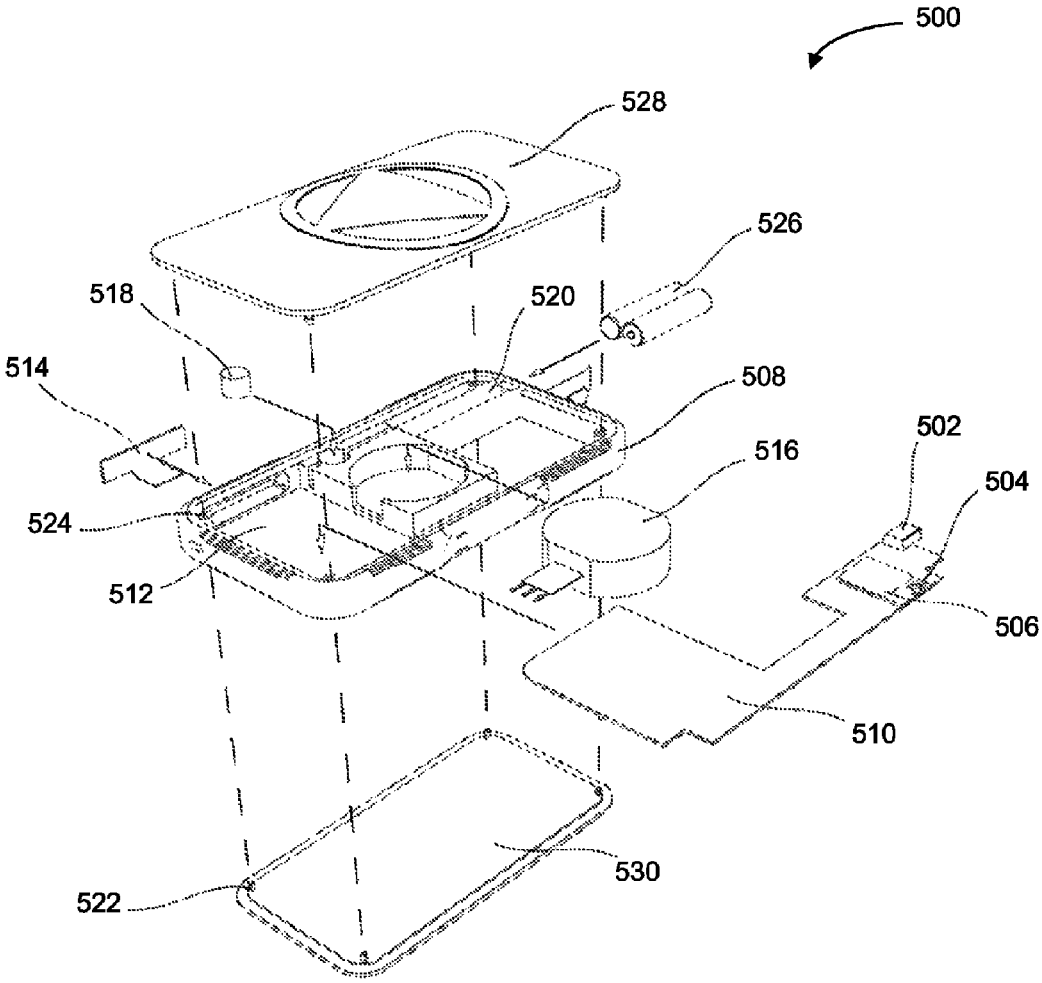
FIG. 5 illustrates an exploded perspective view of an exercise device, according to one or more implementations of the invention.

FIG. 5 illustrates an exploded perspective view of an exercise device 500, according to one or more implementations of the invention. The exercise device 500 may include one or more characteristics and/or functionalities that are similar to that described in connection with the exercise device 102. As shown in FIG. 5, the exercise device 500 may include one or more of wired communications apparatus 502, wireless communications apparatus 504, a processor 506, a frame 508, a circuit board 510, an audio transducer housing 512, display apparatus 514, a force sensor 516, an actuator 518, a power supply housing 520, clips 522, clip openings 524, a power supply 526, top cover 528, bottom cover 530, and/or other components.

The wired communications apparatus 502 may be configured to communicatively couple by wire to one or more components of the exercise system 100 of FIG. 1. The wireless communications apparatus 504 may be configured to communicatively couple wirelessly to one or more components of the exercise system 100 of FIG. 1. The wired communications apparatus 502 and/or the wireless communications apparatus 504 may include similar characteristics and/or functionalities as described in connection with the communications apparatus 116 illustrated in FIG. 1. The processor 506 may include similar characteristics and/or functionalities as described in connection with the processor 130 of FIG. 1. The frame 508 may include similar characteristics and/or functionalities as described in connection with the frame 406 illustrated in FIG. 4. The circuit board 510 may be configured to carry one or more components of the exercise device 500. The audio transducer housing 512 may be configured to house an audio transducer, such as the audio transducer 120 illustrated in FIG. 1. The display apparatus 514 may include similar characteristics and/or functionalities as described in connection with the display apparatus 114 illustrated in FIG. 1. The force sensor 516 may include similar characteristics and/or functionalities as described in connection with the force sensor 112 illustrated in FIG. 1. The actuator 518 may include similar characteristics and/or functionalities as described in connection with the actuator 118 illustrated in FIG. 1. The power supply housing 520 may be configured to house a power supply, such as the power supply 126 illustrated in FIG. 1. The clips 522 and the clip openings 524 may include similar characteristics and/or functionalities as described, respectively, in connection with the clips 410 and the clip openings 412 illustrated in FIG. 4. The power supply 526 may include similar characteristics and/or functionalities as described in connection with the power supply 126 illustrated in FIG. 1. The top cover 528 and the bottom cover 530 may include similar characteristics and/or functionalities as described, respectively, in connection with the top cover 402 and the bottom cover 404 illustrated in FIG. 4.

Figure 6:
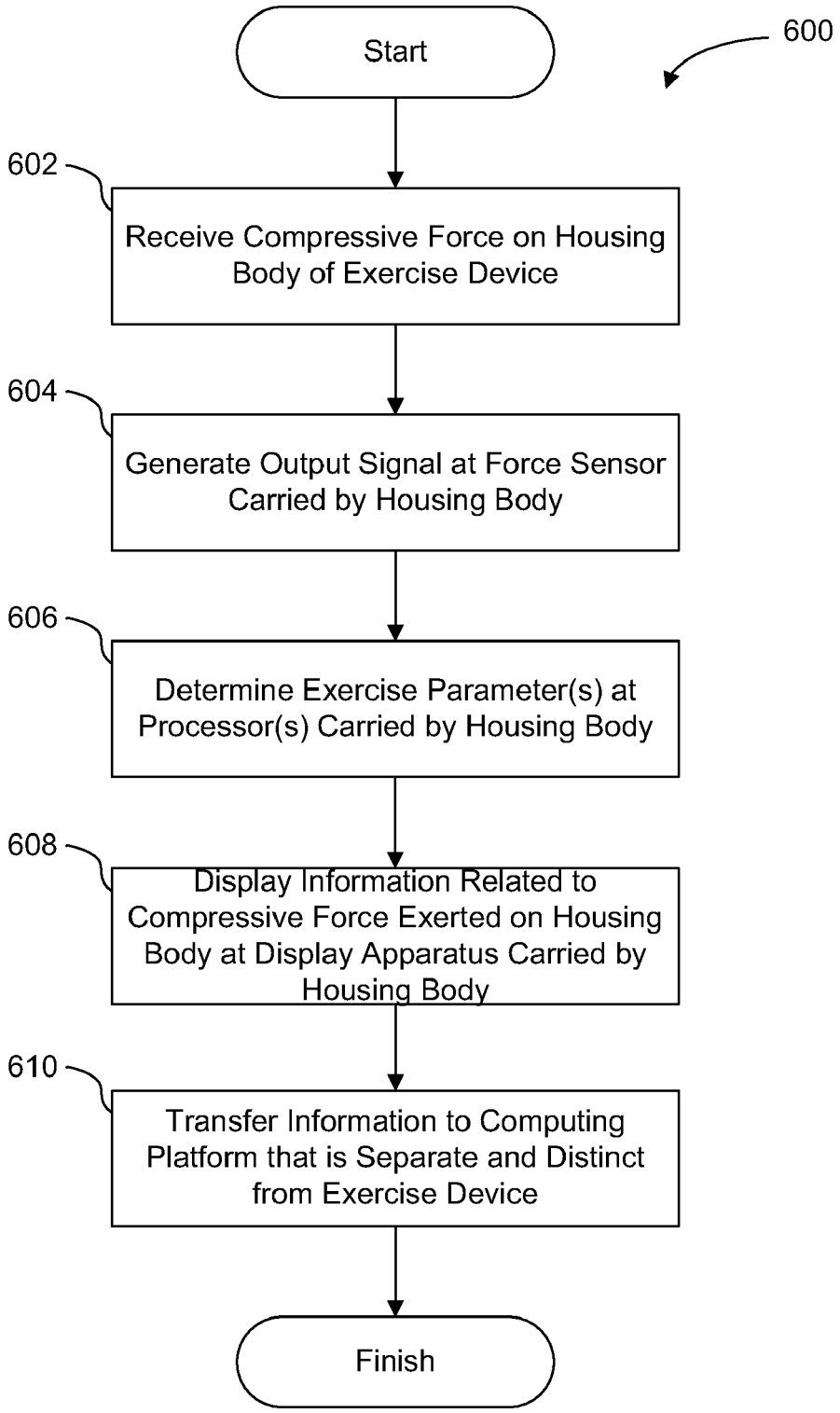
FIG. 6 illustrates a method for quantification of personal exercise using an exercise device configured to facilitate personal exercise, according to one or more implementations of the invention.

FIG. 6 illustrates a method 600 for quantification of personal exercise using an exercise device configured to facilitate personal exercise, according to one or more implementations of the invention. The operations of the method 600 presented below are intended to be illustrative. In some implementations, the method 600 may be accomplished with one or more additional operations not described, and/or without one or more of the operations discussed. Additionally, the order in which the operations of the method 600 are illustrated in FIG. 6 and described below is not intended to be limiting.

In some implementations, the method 600 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of the method 600 in response to instructions stored electronically on an electronic storage medium. The one or more processing devices may include one or more devices configured through hardware, firmware, and/or software to be specifically designed for execution of one or more of the operations of the method 600.

At an operation 602, a compressive force is received on a housing body of an exercise device. The compressive force may be exerted during personal exercise. In some implementations, the compressive force may be received by the housing body 110 of the exercise device 102.

At an operation 604, an output signal is generated at a force sensor carried by the housing body. The output signal may be generated responsive to the received compressive force. According to some implementations, the force sensor 112 may generate the output signal.

At an operation 606, one or more exercise parameters are determined at one or more processors carried by the housing body. The exercise parameters may be based on the output signal generated at the operation 604. In exemplary implementations, the exercise analysis module 134 may be executed to perform the operation 606.

At an operation 608, information related to compressive force exerted on the housing body is displayed at a display apparatus carried by the housing body. The displayed information may be for presentation to a user. The display apparatus 114 in conjunction with the display module 136 may be invoked to perform the operation 608.

At an operation 610, information may be transferred to a computing platform (e.g., the computing platform 104). Such information may be related to one or more of personal exercise, compressive force exerted on the housing body, and/or other information. The computing platform may be physically separate and distinct from the exercise device. The communications module 138 may be executed to perform the operation 610, in accordance with some implementations.

Although the invention has been described in detail for the purpose of illustration based on what is currently considered to be the most practical and preferred implementations, it is to be understood that such detail is solely for that purpose and that the invention is not limited to the disclosed implementations, but, on the contrary, is intended to cover modifications and equivalent arrangements that are within the spirit and scope of the appended claims. For example, it is to be understood that the present invention contemplates that, to the extent possible, one or more features of any implementation can be combined with one or more features of any other implementation.

What is claimed is:

1. An exercise device configured for personal exercise and quantification thereof, the device comprising:

a housing body configured to receive compressive force during personal exercise;

a force sensor carried by the housing body, the forces sensor configured to generate an output signal responsive to compressive force being exerted on the housing body;

a geo-location sensor carried by the housing body and configured to generate a second output signal related to a geo-location of the exercise device; and one or more processors carried by the housing body, the one or more processors configured to execute one or more computer program modules, the one or more computer program modules comprising:

a sensor module configured to receive the second output signal of the geo-location sensor and to receive the output signal of the force sensor; and an exercise analysis module configured to determine one or more exercise parameters based on the received output signal of the force sensor.

2. The exercise device of claim 1, wherein personal exercise includes an exercise performed by a user involving at least one body part of the user, the at least one body part including one or more of arms, hands, legs, feet, torso, or neck.

3. The exercise device of claim 1, further comprising display apparatus carried by the housing body and configured to display, for presentation to a user, information related to compressive force exerted on the housing body, wherein the one or more computer program modules further comprise a display module configured to control the display apparatus to present information related the information related to compressive force.

4. The exercise device of claim 1, further comprising communications apparatus carried by the housing body and configured to transmit information related to one or both of personal exercise or compressive force exerted on the housing body, wherein the one or more computer program modules further comprise a communications module configured to control the communications apparatus to transmit the information.

5. The exercise device of claim 4, wherein the communications apparatus is configured to receive one or both of software updates or firmware updates.

6. The exercise device of claim 4, wherein the communications apparatus is configured to communicatively couple to a user accessory to convey information related to one or both of personal exercise or compressive force exerted on the housing body, wherein the user accessory is physically separate and distinct from the exercise device.

7. The exercise device of claim 4, wherein the communications apparatus is configured to communicatively couple to a computing platform configured to receive and process information related to one or both of personal exercise or compressive force exerted on the housing body, wherein the computing platform is physically separate and distinct from the exercise device.

8. The exercise device of claim 1, further comprising an actuator carried by the housing body and configured to provide tactile feedback to a user, wherein the one or more computer program modules further comprise a tactile feedback module configured to control the actuator to provide the tactile feedback.

9. The exercise device of claim 1, further comprising an audio transducer carried by the housing body and configured to provide audio feedback to a user, wherein the one or more computer program modules further comprise an audio module configured to control the audio transducer to provide the audio feedback.

10. The exercise device of claim 1, further comprising a user interface carried by the housing body and configured to present user configurable settings to a user, and to receive selections from the user of values for the user configurable settings.

11. The exercise device of claim 1, further comprising a power supply carried by the housing body, wherein the one or more computer program modules further comprise a power management module configured to manage power delivered by the power supply.

12. The exercise device of claim 1, further comprising electronic storage carried by the housing body and configured to store information related to the compressive force.

13. The exercise device of claim 1, wherein the one or more computer program modules further comprise a coaching module configured to provide one or more of verbal or textual conveyance of the one or more exercise parameters, coaching tips related to personal exercise, encouraging statements, guidance related to personal exercise, comparative information of current personal exercise or prior personal exercise.

14. The exercise device of claim 1, wherein the one or more computer program modules further comprise a sensor module configured to timestamp information related to the compressive force exerted on the housing body based on the output signal of the force sensor.

15. The exercise device of claim 1, wherein the housing body is configured to be coupled to a strap, the strap being configured to facilitate exertion of compressive force on the housing body responsive to a tensive force exerted on the strap.

* * * * *